United States Patent [19]

Nerlich et al.

[11] Patent Number: 4,755,083

[45] Date of Patent: Jul. 5, 1988

[54] ADJUSTABLE CAP UNIT

[75] Inventors: Ernst-Günter Nerlich, Essen; Hans-Ferdinand Bemmerl, Herne, both of Fed. Rep. of Germany

[73] Assignee: Bochumer Eisenhütte Heintzmann GmbH & Co. KG, Bochum, Fed. Rep. of Germany

[21] Appl. No.: 928,326

[22] Filed: Nov. 6, 1986

[30] Foreign Application Priority Data

Nov. 16, 1985 [DE] Fed. Rep. of Germany ..... 3540807

[51] Int. Cl.[4] ..... E21D 17/00

[52] U.S. Cl. ..... 405/293; 405/291

[58] Field of Search ..... 405/291, 293, 294, 296, 405/302; 299/33; 91/170 MP

[56] References Cited

U.S. PATENT DOCUMENTS 3,732,699 5/1973 Stevenson ..... 405/294

4,447,174 5/1984 Becker et al. ..... 405/293

OTHER PUBLICATIONS

"Schildausbautyp G320-12/27 fürmittlere Flöze", Brochure 6.81 of Firma Hermann Hemscheidt Maschinenfabrik GmbG & Co.

*Primary Examiner*—David H. Corbin

*Attorney, Agent, or Firm*—Toren, McGeady & Associates

[57] ABSTRACT

An adustable cap unit for a mine support frame including a main cap, an adjustable cap connected to the main cap with a hinge-type connection, an adjusting cylinder mechanism extending within the widths of the main cap and the adjustable cap, and a guide for guiding a portion of the adjusting cylinder mechanism in a restrictive manner. The adjusting cylinder mechanism is provided either in the main cap or in the adjustable cap and an end portion of the adjusting cylinder mechanism is hinged to a bearing member provided at the bottom edges of the main cap or the adjustable cap adjacent the hinge-type connection. The adjustable cap unit can be used in extremely small seam thicknesses of as little as approximately 500 mm, while the contact pressure available at the front end of the adjustable cap is sufficient.

11 Claims, 2 Drawing Sheets

ADJUSTABLE CAP UNIT

BACKGROUND OF THE INVENTION

1. Field of The Invention

The present invention relates to an adjustable cap unit for a mine support frame, particularly for a shield-type support frame. The adjustable cap unit includes a main cap and an adjustable cap hinged to the main cap by means of a hinge connection provided on the roof side of the caps. The adjustable cap unit further includes an adjusting cylinder which is hinged to the adjustable cap and to the main cap and is located underneath the hinge connection within the width of the adjusting cap and main cap.

2. Description of the Prior art

Adjustable caps of the type described are used, for example, where the hanging roof is to be upheld as early as possible immediately next to the working face with a positive pressure. For that purpose, the adjustable caps are connected to the main caps by means of hinged axles extending in the longwall direction. The hinge axles are generally provided slightly underneath the upper sides of the caps. The positive pressure at the front end of an adjustable cap is obtained by means of at least one hydraulically operated adjusting cylinder which extends across the hinge connection and is hinged to the adjustable cap and the main cap.

As long as the available seam thickness permits a sufficient clearance for travel underneath the caps, it is usually not difficult to provide an adjusting cylinder underneath the caps. However, if the adjusting cylinder is to be arranged within the caps, these caps must have a minimum thickness, particularly in the region of the hinge connection, in order to accommodate an adjusting cylinder which is capable of providing the necessary pressure at the front end of the cap (Brochure 6.81 of Firma Hermann Hemscheidt Maschinenfabrik GmbG & Co. "Schildausbautyp G 320 - 12/27 für mittlere Flöze" [Shield-type support model G 320 - 12/27 for medium-sized seams]). In the case of small seam thicknesses, a unit of the type described above can not be used because the thickness of the cap makes it generally not possible to ensure the minimum permissible travel clearance of 400 mm. It must be further taken into consideration in these cases that the clearance between the bottom sides of the caps and the upper sides of structure located on the backfill side of the support conveyor, such as, spill plates, is not large enough to permit observation from the travel area of the conveyor, the extraction machine and the working face in a manner which is acceptable with respect to safety requirements.

It is, therefore, the primary object of the present invention to improve the adjustable cap unit of the type described above, so that, even in the case of extremely small seam thicknesses of as little as about 500 mm, a minimum clearance of 400 mm is ensured while particularly the adjustable cap has sufficient stiffness with respect to bending and twisting and the adjustable cap can exert the necessary positive contact pressure at the front end of the cap.

SUMMARY OF THE INVENTION

In accordance with the present invention, the adjustable cap unit includes an adjusting cylinder mechanism which extends within the adjustable cap or the main cap. The adjusting cylinder mechanism is over a portion of its length guided by a restrictive guiding means either on the working face side or the backfill side of the hinge connecting the main cap with the adjustable cap. An end portion of the adjusting cylinder mechanism located underneath the longitudinal axis of the adjusting cylinder mechanism is hinged to a bearing member provided at the lower front edge of the main cap or on the lower edge of the backfill side of the adjustable cap.

Since at least a portion of the adjusting cylinder mechanism hinged to the bearing is guided by a restrictive guiding means, the transmission of harmful transverse stresses to the adjusting cylinder is prevented. Moreover, although the structural height of the adjustable cap unit in the hinge region between the adjustable cap and the main cap is small, the lever arm available between the longitudinal axis of the hinge connection and the longitudinal axis of the bearing is still large enough to be able to apply the required positive contact pressure at the front end of the the adjustable cap by means of an adjusting cylinder which is of an acceptable size. It is possible to use an adjustable cap whose width is uniform over its entire length between the working face and the hinge region with the main cap.

If the bearing member is provided in the lower edge of the main cap facing the working face, the adjusting cylinder mechanism is located in the adjustable cap. On the other hand, if the bearing member is welded to the lower edge of the adjustable cap facing the backfill, the adjusting cylinder mechanism is located in the main cap. Of course, in the above-described manner, it is also possible to provide two or more adjusting cylinders in the adjustable cap or in the main cap. Furthermore, it is conceivable to provide at least one adjusting cylinder each in the adjustable cap as well as in the main cap in order to be able to apply the necessary contact pressures at the front end of the adjustable cap.

The afore-described guidance of a portion of the adjusting cylinder mechanism by a restrictive guiding means may be effected by a sleeve within which are slidably received either longitudinally extending portions of the piston rod or of the cylinder housing or a guide member which is connected in an articulated manner to the piston rod or to the cylinder housing. The other end of the adjusting cylinder is connected directly in an articulated manner to the adjustable cap or to the main cap.

The end portion of the adjustable cylinder mechanism may be a fork-shaped head member which is open toward the bottom and which engages from the top a bolt which forms part of the bearing member. As a result of this arrangement, the adjusting cylinder can be mounted and dismounted more easily and the movements of the bearing member relative to the hinge connection are made possible. In addition, the structural height may be kept low, particularly in the hinge region between the adjustable cap and the main cap.

The hinge connection between the adjustable cap and the main cap may be formed by at least two cylinders fastened along the upper front edge of the main cap and by half shells which are open toward the top and are attached to the upper edge of the adjustable cap facing the backfill, the half shells engaging the cylinders from below. This arrangement makes it possible to further reduce the width of the cap while the stiffness with respect to twisting and bending remains sufficient.

The half shells attached to the adjustable cap and forming part of the hinge connection between the adjustable cap and the main cap are supported by abutments which are placed in the main cap between an upper plate and a lower plate of the main cap. These abutments further serve to simplify the assembly of the entire adjustable cap unit. The cylinders as well as the half shells do not project toward the hanging roof above the upper sides of the main cap or the adjustable cap. In the direction toward the footwall, the half shells rest on the abutments by sliding with their cylindrical outer surfaces on these abutments. In the simplest case, the abutments are thrust members which are releasably fastened between the upper and lower plates of the main cap by means of threaded bolts, pins or clamping sleeves.

The assembly and disassembly of the abutments is facilitated by providing recesses in the lower plate of the main cap.

The longitudinal edges of the half shells facing the backfill project into recesses formed in the front of the upper plate of the main cap. These recesses are located approximately in the middle of the cylinders as seen in the longitudinal direction thereof. The longitudinal edges of the half shells facing the backfill engage into these recesses formed between the cylinders and the upper plate of the main cap only to such an extent that the edges do not project above the upper side of the main cap even when the adjustable cap is pivoted to the maximum possible extent toward the footwall.

As described above, the adjusting cylinder mechanism may be arranged either in the adjustable cap or in the main cap. Adjusting cylinder mechanisms may be arranged in various configurations. For example, at least two adjusting cylinders may be arranged parallel to one another. The two adjusting cylinders are operatively connected by a crossbar and may be connected in an articulated manner by means of a guide member to a bearing member provided on the front lower edge of the main cap or on the lower edge of the adjustable cap facing the backfill. In that case, the guide member is guided in a sleeve attached preferably by welding to the adjustable cap or to the main cap. The guide member is further connected in an articulated manner to the center region of the crossbar. Thus, any transverse stresses acting on the guide member during pivoting of the adjustable cap can not have any disadvantageous effects on the adjusting cylinder.

A sliding cap may be placed in a hood-like manner over the adjustable cap. The sliding cap is guided by restrictive guiding means provided on the sides of the adjustable cap. Sliding of the sliding cylinder is effected by means of at least one sliding cylinder embedded in the adjustable cap. The guide means for the sliding cap are formed by circular rods which are welded to the adjustable cap and are engaged by half shells. The half shells are connected to the top plate of the sliding cap in such a way that the adjustable cap is completely received in the sliding cap. The sliding cylinders are connected with one end to the inner side of the front plate of the sliding cap facing the working face and with the other end to fork-type lugs which project downwardly toward the footwall from the upper plate of the adjustable cap at the end facing the backfill.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE DRAWING

Figure 1:
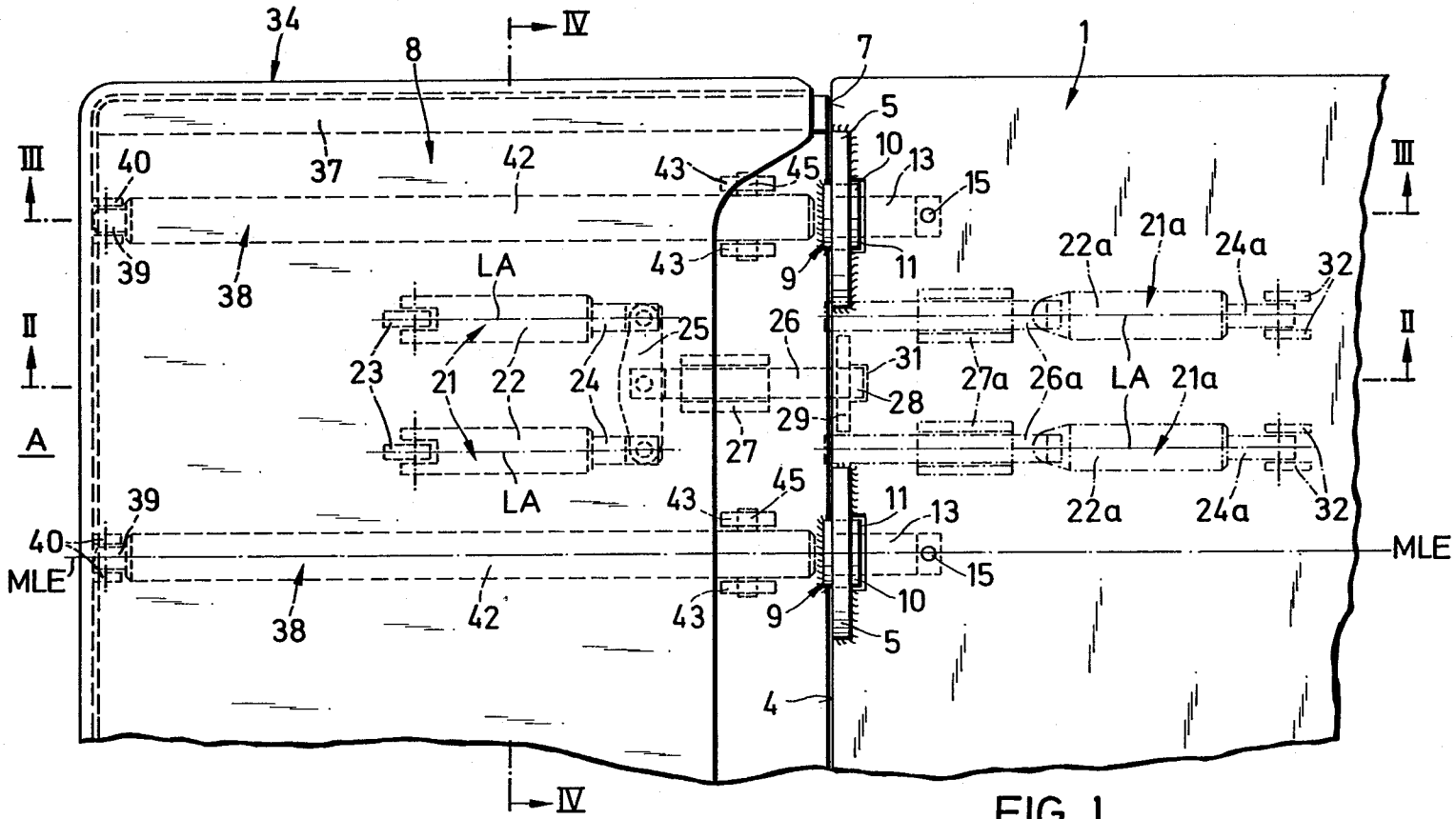
FIG. 1 is a partial top view of the adjustable cap unit according to the present invention for a shield-type support frame.
Figure 2:
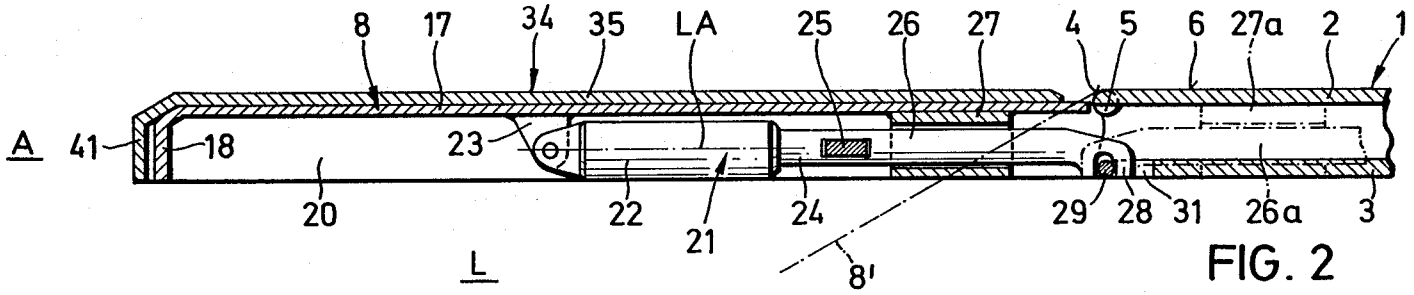
FIG. 2 is a vertical longitudinal sectional view of the adjustable cap unit taken along sectional line II—II of FIG. 1.
Figure 3:
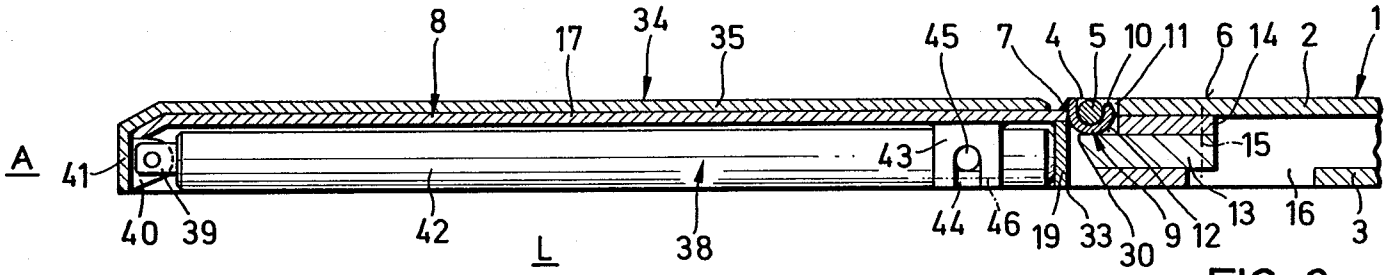
FIG. 3 is a vertical longitudinal sectional view of the adjustable cap unit taken along sectional line III—III of FIG. 1.

In FIGS. 1 to 3 of the drawing, reference numeral 1 denotes a main cap of a shield-type support frame, not illustrated in detail, to be used in underground mining. Main cap 1 is designed for extremely small seam thicknesses and, over a predominant portion of its length, is composed of an upper plate and a lower plate 3 which are connected to one another to provide stiffness with respect to twisting and bending, see particularly FIGS. 2 and 3.

As FIGS. 1 to 3 further show, altogether three cylinders 5 are connected to an upper edge 4 of the main cap 1 which faces the working face A. The cylinders are preferably fastened by welding. The cylinders 5 are placed in recesses of the upper plate 2 in such a way that the cylinders 5 do not project above the upper side 6 of main cap 1. The cylinders 5 are arranged along the upper edge 4 so as to be uniformly spaced relative to one another.

An adjustable cap 8 extends from the front end of the main cap 1 to the working face A. FIGS. 1 and 3 show that cylindrical half shells 9 which are open toward the top are welded to the upper edges 7 of the adjustable cap 8 in the middle portion of the cylinders 5 as seen in longitudinal direction thereof. Half shells 9 engage the cylinders 5 from below so as to rotate relative to the cylinders 5. Longitudinal edges 10 of the shells 9 facing the backfill extend into recesses 11 formed in the upper plate 2 of the main cap 1 in such a way that the edges 10 do not project above the topside 6 of the main cap 1 even when the adjustable cap 8 is pivoted downwardly to the footwall L, as indicated by dash-dot line 8' in FIG. 2.

As illustrated in FIG. 3, outer surfaces 12 of the half shells 9 slide on rectangular thrust members 13 which are removably mounted between the upper plate 2 of the main cap 1 and the lower plate 3 or between a reinforcing plate 14 and the lower plate 3. The thrust members 13 may be fixed in place by means of clamping sleeves 15. The thrust members 13 are assembled and disassembled through recesses 16 formed in lower plate 3.

The adjustable cap 8 is essentially of box-type construction and is provided with the necessary stiffness with respect to twisting and bending. Adjustable cap 8 has a cover plate 17, an angular end plate 18 and a shielding plate 19 on the side facing the backfill, as can be seen from FIGS. 2 and 3, and side plates 20, illustrated in FIGS. 2 and 4. Plates 17 to 20 are welded together.

With respect to the vertical center plane MLE of the adjustable unit illustrated in FIGS. 1 and 2, two hydraulic adjusting cylinders 21 are provided on either side of the plane MLE. The cylinders 21 are connected with housings 22 to lugs 23 which project downwardly from cover plate 17 of adjustable cap 8. The adjusting cylinders 21 have piston rods 24 which extend toward the backfill and are connected to one another by means of a crossbar 25. A guide member 26 of circular cross-section is connected to middle of the crossbar 25. Guide member 26 extends through a guide sleeve 27 which is welded to the cover plate 17 of the adjustable cap 8 and ends at a fork-shaped head 29 which is open toward the bottom. The head 28 is located below the longitudinal axis LA of the adjusting cylinder 21 and engages a bolt 29 which is welded to the lower edge 30 of the main cap 1 which faces the working face. A recess 31 provided between bolt 29 and lower plate 3 of main cap 1 makes possible a problem-free engagement by head 28 in all positions of the adjustable cap 8 relative to the main cap 1.

In accordance with another embodiment of the invention illustrated in FIGS. 1 and 2, two adjusting cylinders **21*a* are provided in the main cap 1. The adjusting cylinders 21*a* are spaced apart and extend parallel to one another. Two cylinders 21*a* each are provided on both sides of the center plane MLE. In this embodiment, the piston rods 24*a* of adjusting cylinders 21*a* are connected in an articulated manner to fork-type lugs 32 which are fastened in main cap 1. Guide members 26*a* extend from cylinder housings 22*a* through guide sleeves 27*a* welded to main cap 1. Similar to the above-described embodiment with crossbar, the ends of the guide members 26*a* are provided with fork-shaped heads which are open toward the bottom. However, in this case, the heads engage bolts 29 which are welded to the bottom edge 33 of adjustable cap 8** facing the backfill.

Of course, in both embodiments described with respect to FIGS. 1 and 2, the housings 22, **22*a* and the piston rods 24, 24*a*** may be mounted in the reverse order.

Figure 4:
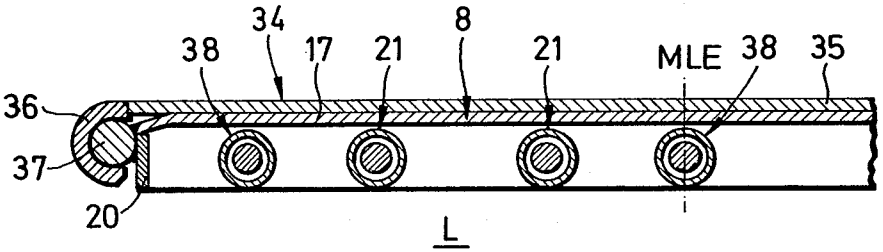
FIG. 4 is a vertical transverse sectional view of the adjustable cap unit taken along sectional line IV—IV of FIG. 1.

As further illustrated in the drawing, a sliding cap 34 is placed in a hood-like manner of adjustable cap 8. The cover sheet 35 of the sliding cap 34 is located approximately in one plane with the upper plate 2 of the main cap 1. Half shells 36 are welded to the sides of the cover plate 35 of sliding cap 34, as illustrated in FIG. 4. Half shells 36 engage circular bars 37 which are welded to the sides of the adjustable cap 8. In this manner, sliding cap 34 is positively guided in longitudinal direction of the adjustable cap 8.

The movement of the sliding cap 34 relative to the adjustable cap 8 is effected by altogether three hydraulic sliding cylinders 38. The piston rods 39 of the sliding cylinders 38 are connected to fork-type lugs 40 which are fastened to the inner side of the end plate 41 of the sliding cap 34. The sliding cylinders 38 have housings 42 which engage lugs 43 provided in the region of the adjustable cap 8 near the backfill. The lugs project downwardly from the cover plate 17 of adjustable cap 8 and have recesses 44 which are open toward the bottom. Tranverse bolts 45 and longitudinal bolts 46 serve to secure the position of the sliding cylinders 38 within the adjustable cap 8.

As particularly FIGS. 2 and 3 show, the width of the adjustable cap 8 is uniform over its entire length and is the same as the width of main cap 1. Also, no structural parts project downwardly beyond caps 1 and 8.

While specific embodiments of the invention have been shown and described in detail to illustrate the application of the inventive principles, it will be understood that the invention may be embodied otherwise without departing from such principles.

We claim:

1. An adjustable cap unit for a mine support frame, comprising a main cap, an adjustable cap, a hinge-type connection for connecting the main cap to the adjustable cap, the hinge-type connection located on the side of the caps facing the hanging roof, an adjusting cylinder mechanism located underneath the hinge-type connection and extending within the widths of the main cap and the adjustable cap, the adjusting cylinder mechanism connected to the main cap and the adjustable cap, a bearing member attached to the bottom front edge of the main cap facing the working face, the adjusting cylinder mechanism arranged within and hinged to the adjustable cap, an end portion of the adjusting cylinder mechanism hinged to the bearing member, the end portion located below the longitudinal axis of the adjusting cylinder mechanism, and guiding means provided in the adjustable cap for guiding the adjusting cylinder mechanism over a portion of its length in a restrictive manner.

2. An adjustable cap unit for a mine support frame, comprising a main cap, an adjustable cap, a hinge-type connection for connecting the main cap to the adjustable cap, the hinge-type connection located on the side of the caps facing the hanging roof, an adjusting cylinder mechanism located underneath the hinge-type connection and extending within the widths of the main cap and the adjustable cap, the adjusting cylinder mechanism connected to the main cap and the adjustable cap, a bearing member attached to the bottom edge of the adjustable cap facing the backfill, the adjusting cylinder mechanism arranged within and hinged to the main cap, an end portion of the adjusting cylinder mechanism hinged to the bearing member, the end portion located below the longitudinal axis of the adjusting cylinder mechanism, and guiding means provided in the main cap for guiding the adjusting cylinder mechanism over a portion of its length in a restrictive manner.

3. An adjustable cap unit according to claim 1 or 2, wherein the support frame is a shield-type support frame.

4. An adjustable cap unit according to claim 1 or 2, wherein the end portion of the adjusting cylinder mechanism is a fork-shaped head member which is open toward the bottom, the bearing member including a bolt which is engaged from the top by the head member.

5. An adjustable cap unit according to claim 1 or 2, wherein the hinge-connection between the adjustable cap and the main cap includes at least two cylinders fastened along the upper front edge of the main cap, and half shells attached to the upper edge of the adjustable cap facing the backfill, wherein the half shells are open toward the top and engage the cylinders from below.

6. An adjustable cap unit according to claim 5, wherein the main cap has an upper plate and a lower plate, comprising abutments placed between the upper and lower plates, the half shells attached to the adjustable cap being placed on and supported by the abutments.

7. An adjustable cap unit according to claim 6, wherein the lower plate of the main cap defines recesses adjacent the hinge-type connection, so that the abutments can be assembled and disassembled through the recesses.

8. An adjustable cap unit according to claim 5, wherein the upper plate of the main cap defines recesses at the front edge thereof, the longitudinal edges of the half shells facing the fackfill engaging in the recesses.

9. An adjustable cap unit according to claim 1 or 2, wherein the adjusting cylinder mechanism comprises two parallel cylinders, a crossbar coupling the housings or piston rods of the cylinders, and a guide member connected to the crossbar and engaging the bearing member, wherein the guiding means guides the member over a portion of its length.

10. An adjustable cap unit according to claim 9, wherein the guiding means is a sleeve which coaxially receives the guide member.

11. An adjustable cap unit according to claim 1 or 2, comprising a sliding cap placed in a hood-like manner over the adjustable cap, so that the sides of the adjustable cap guide the sliding cap in a defined manner, and at least one sliding cylinder for adjusting the sliding cap relative to the adjustable cap.

* * * * *